US007699432B2

(12) United States Patent
Simmons et al.

(10) Patent No.: US 7,699,432 B2
(45) **Date of Patent: *Apr. 20, 2010**

(54) METHOD AND SYSTEM OF CAPPING THAT EMPLOYS A TREADMILL BELT

(75) Inventors: Laura Elisabeth Simmons, Corvallis, OR (US); Jonathan Neal Andrews, MoMinnville, OR (US); Stephen V. Cooper, Amity, OR (US)

(73) Assignee: Marvell International Technology Ltd. (BM)

( * ) Notice: Subject to any disclaimer, the term of this patent is extended or adjusted under 35 U.S.C. 154(b) by 0 days.

This patent is subject to a terminal disclaimer.

(21) Appl. No.: 11/391,095

(22) Filed: Mar. 27, 2006

(65) Prior Publication Data

US 2006/0170728 A1 Aug. 3, 2006

Related U.S. Application Data

(63) Continuation of application No. 09/948,343, filed on Sep. 5, 2001.

(51) Int. Cl.
*B41J 2/165* (2006.01)

(52) U.S. Cl. ..... 347/33; 347/32

(58) Field of Classification Search ..... 347/22–36
See application file for complete search history.

(56) References Cited

U.S. PATENT DOCUMENTS 4,872,026 A * 10/1989 Rasmussen et al. ..... 347/56
4,935,753 A 6/1990 Lehmann et al.
5,005,024 A 4/1991 Takahashi et al.
5,097,276 A * 3/1992 Midorikawa ..... 347/32
5,103,244 A 4/1992 Gast et al.
5,303,018 A 4/1994 Terada et al.
5,486,850 A 1/1996 Nakamura
5,500,660 A 3/1996 Childers et al.
5,548,309 A 8/1996 Okubo et al.
5,663,751 A * 9/1997 Holbrook ..... 347/22

(Continued)

FOREIGN PATENT DOCUMENTS

EP 0 956 956 A2 11/1999

(Continued)

OTHER PUBLICATIONS

U.S. Appl. No. 09/948,343, filed Sep. 5, 2001, Simmons et al.

(Continued)

*Primary Examiner*—Manish S Shah
*Assistant Examiner*—Leonard S Liang

(57) ABSTRACT

A service station for a pen that incldues a treadmill belt that has an outer surface and an inner surface and a pen cap positioned on the outer surface of the treadmill belt, wherein the pen cap is positioend between the treadmill belt and the pen. THe service statin further including two rollers upon which the treadmill belt is mounted, wherein the two rollers contact the inner surface of the treatmill belt for driving the treadmill belt. In addition, there is no device positioned between the two rolelrs that engages the inner surface of the treadmill belt so as to move the outer surface toward the pen. THe service statino further includes a drive axle coupled to one of the rollers and a mechanism for switching a direction of travel of the treadmill belt.

48 Claims, 8 Drawing Sheets

U.S. PATENT DOCUMENTS

| | | | | |
|---|---|---|---|---|
| 5,672,017 | A * | 9/1997 | Taniguchi | 400/120.16 |
| 5,774,139 | A | 6/1998 | Salzer et al. | |
| 5,786,830 | A | 7/1998 | Su et al. | |
| 5,949,448 | A | 9/1999 | Man et al. | |
| 5,988,789 | A | 11/1999 | Nakahara | 347/32 |
| 6,137,504 | A | 10/2000 | Kawai et al. | 347/33 |
| 6,179,419 | B1 | 1/2001 | Rasmussen et al. | |
| 6,231,157 | B1 | 5/2001 | Saijo | |
| 6,530,642 | B1 | 3/2003 | Uchikata et al. | |
| 6,536,866 | B1 * | 3/2003 | Uchikata | 347/24 |
| 6,561,618 | B1 * | 5/2003 | Simmons et al. | 347/32 |
| 2004/0155921 | A1 | 8/2004 | Simmons et al. | |

FOREIGN PATENT DOCUMENTS

| | | | |
|---|---|---|---|
| EP | 1 010 535 | A2 | 6/2000 |
| EP | 1 208 993 | A1 | 5/2002 |
| JP | 03-234623 | A | 10/1991 |
| JP | 4-539 | U | 1/1992 |
| JP | 04-241957 | | 8/1992 |
| JP | 06-023999 | A | 2/1994 |
| JP | 06023999 | A * | 2/1994 |
| JP | 06-344565 | | 12/1994 |
| JP | 07-101053 | | 4/1995 |
| JP | 8-867 | U | 5/1996 |
| JP | 08-169159 | | 7/1996 |
| JP | 09123470 | A * | 5/1997 |
| JP | 10-217492 | A | 8/1998 |
| JP | 10-250088 | | 9/1998 |
| JP | 11-227179 | | 8/1999 |
| JP | 11-320915 | A | 11/1999 |
| JP | 2000 177113 | A | 6/2000 |
| JP | 2000 198210 | A | 7/2000 |
| JP | 2000-198210 | A | 7/2000 |
| JP | 2001-138546 | | 5/2001 |

OTHER PUBLICATIONS

Berg, Richard H., "Reverse Shaft Mechanism," Xerox Disclosure Journal published by Xerox, vol. 25, No. 2, Mar./Apr. 2001, p. 69.

Patent Abstracts of Japan publication regarding Japanese patent publication 2000 198210, published by Japanese Patent Office, vol. 2000, No. 10, Nov. 17, 2000, one page.

Berg, Richard H., "Reverse Shaft Mechanism," Xerox Disclosure Journal published by Xerox, vol. 25, No. 2, Mar./Apr. 2001, p. 69.

* cited by examiner

METHOD AND SYSTEM OF CAPPING THAT EMPLOYS A TREADMILL BELT

This is a Continuation of copending application Ser. No. 09/948,343, filed on Sep. 5, 2001, the entire disclosure of which is incorporated herein by reference.

FIELD OF THE INVENTION

The present invention relates generally to thermal inkjet (TIJ) printers, and more particularly, to a method and system for maintaining pens in thermal inkjet printers that employs a treadmill belt.

BACKGROUND OF THE INVENTION

Thermal inkjet (TIJ) printers are now commonly found in homes and offices. TIJ printers offer good print quality at a very affordable price. TIJ printers employ pens to apply ink to paper or other printing medium. For example, a black pen is provided for printing black ink. Similarly, a multi-color pen is utilized to apply color inks to a paper. Each pen typically includes a cavity for holding the ink and a nib for delivering the ink. The nib holds a print head, which is typically made of a silicon material that controls the delivery of the ink. The print head includes hundreds of orifices through which ink is delivered.

Some orifices are fired very frequently. Other orifices are fired very infrequently. In any case, inkjet pens require frequent wiping to remove excess ink from the orifices and to prevent ink depositions from hardening in or around the orifices. As can be appreciated, hardened ink deposits can cause the orifices to clog or jam, thereby adversely affecting print quality.

Currently, some thermal inkjet (TIJ) printers include a sub-assembly that is often referred to as a "service station" for maintaining the TIJ pens. The service station maintains the pens by wiping excess ink from the orifice, thereby increasing the life of the pens and enhancing the performance of the pens.

Multi-Pass Printer with Stationary Service Station

FIG. 1 illustrates a first type of prior art multi-pass TIJ printer where the service station is stationary, and the carriage moves with respect to the stationary service station. The multi-pass printer has nozzles that are positioned in a first orientation 110. The first orientation 110 is generally parallel to the direction of carriage motion. The black ink firing nozzles 114 are arranged generally in a single horizontal band. Similarly, the color ink firing nozzles 118 are arranged generally in horizontal bands stack upon each other with each band having nozzles for a particular color (e.g., cyan, magenta and yellow). This type of printer requires multiple passes to complete a printing job.

A piece of paper is fed through a paper path in the printer. A feed roller and other rollers are driven by a plurality of gear trains that are driven by a paper path DC motor. A carriage moves generally in the directions shown and is driven by a carriage DC motor. A linear encoder is also provided for controlling the movement of the carriage. The carriage includes a plurality of pens that deposit ink onto the paper. A stationary service station is provided for maintaining the pens. Maintenance of the pens involves periodically wiping the pens and capping the pens when the pens are not in use.

For these printers, the motion required for wiping and capping the pens is parallel to the direction of the pen movement on the carriage. These TIJ printers (e.g., Lexmark brand TIJ printers) use the motion of the pens across the paper, which is driven by the carriage DC motor, and a stationary service station to service the pens.

At the end of a print job, the pens move to the far right side of the printer, where the pens hit a lever that moves the caps into place. When a new print job starts, the pens are moved to the extreme left of the printer. The start of this movement releases the capping switch and lowers the caps halfway, thereby bringing the wipers into position. As the pens continue their motion, the orifices are wiped. After the final wiping motion is completed, the pen motion pulls the wipers into a "rest" position that does not interfere with the normal operation of the carriage.

One disadvantage of these types of printers is the speed at which pages are printed, which is typically measured by the number of pages per minute. As can be appreciated, multi-pass type printers typically take a longer time to print pages than a single-pass printer that is described in greater detail hereinafter. Consequently, as the demand for printers that have faster printing speeds increases, the demand for single-pass printers increases proportionately.

One benefit of a stationary service station is that the arrangement is relatively cost-effective. Unfortunately, this type of arrangement for pen servicing and maintenance is not suitable for single-pass printers for the reasons set forth hereinafter.

Single-Pass Printer with Moving Service Station

FIG. 2 illustrates a second type of prior art single-pass TIJ printer where a dedicated motor controls the movement of the service station. The single-pass printer (also referred to as a complete swath printer) has nozzles that are positioned in an second orientation 120 that is generally perpendicular to the direction of carriage motion, thereby enabling all the different color nozzles to fire simultaneously. The black ink firing nozzles 124 are arranged generally in a single vertical band. Similarly, the color ink firing nozzles 128 are arranged generally in vertical bands that are arranged adjacent to with each other with each vertical band having nozzles for a particular color (e.g., cyan, magenta and yellow). Examples of this type of TIJ printer include the Hewlett-Packard 800 and 900 series.

For these printers, motion of a service station (e.g., the service station pallet) is required to perform the pen-servicing operations. This motion is achieved by using a stepper motor to maneuver the entire service station assembly.

For multiple colors, the wiping function performed by the service station has an additional complication. This complication is that the service station needs to be moved in a particular manner with respect to the firing nozzles in order to prevent cross-contamination of the ink.

In color printers, if the wiper crosses from cyan to magenta to yellow, the color inks contaminate each other. In other words, when one wiper blade services multiple colors, and a particular portion of the wiper (e.g., a particular wiper surface) is passed over firing nozzles of different colors, the ink supplies are contaminated.

When the wiping motion runs along a single color without crossing different color boundaries (i.e., a particular portion of the wiper passes over firing nozzles of a single color), then the inks do not contaminate each other. Consequently, it is important in the design of the service station that the direction of the wipe is ensured to be along the same direction as the placement of the firing nozzles of the print head.

Additionally, perpendicular TIJ printers provide an isolated space for the spittoon and move that spittoon into position. The isolation keeps the excess ink away from the other contents of the printer.

It is noted that the Hewlett-Packard type of single-pass printers utilize a platform, a separate dedicated motor to drive the platform, and one or more gear trains for transferring the motion of the motor to the platform. These components are needed to cause the wiper blades that are mounted on the platform to perform the maintenance functions of the service station. As can be appreciated, these components increase the weight, cost, and complexity of the printer.

As the costs of printers decreases and the competition in the thermal inkjet printer market increases, there is a constant demand for designs for the various sub-assemblies that can reduce the number of parts needed for a particular sub-assembly and hence reduce the costs associated with manufacturing the printer.

Consequently, it is desirable for there to be a service station that performs the wiping and cleaning functions of prior art service station while at the same time reducing the part count and costs associated with the manufacture of the service station.

Based on the foregoing, there remains a need for pen maintenance method and system for thermal inkjet printers that overcomes the disadvantages set forth previously.

SUMMARY OF THE INVENTION

According to one embodiment of the present invention, a service station for maintaining or servicing pens is provided. The service station includes a treadmill belt that has an outer surface and an inner surface. At least one wiper is positioned on the outer surface of the treadmill belt. The treadmill belt is mounted on a first roller and a second roller. The first roller and the second roller contact the inner surface of the treadmill belt for driving the treadmill belt. Either the first roller or the second roller can be coupled to a drive axle. Preferably, the drive axle is coupled to a paper motor via a paper drive shaft. The wiper can be, for example, a flicker squeegee or a wicking squeegee.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION

A pen wiping method and system for ink jet printers are described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Service Station 20

Figure 3:
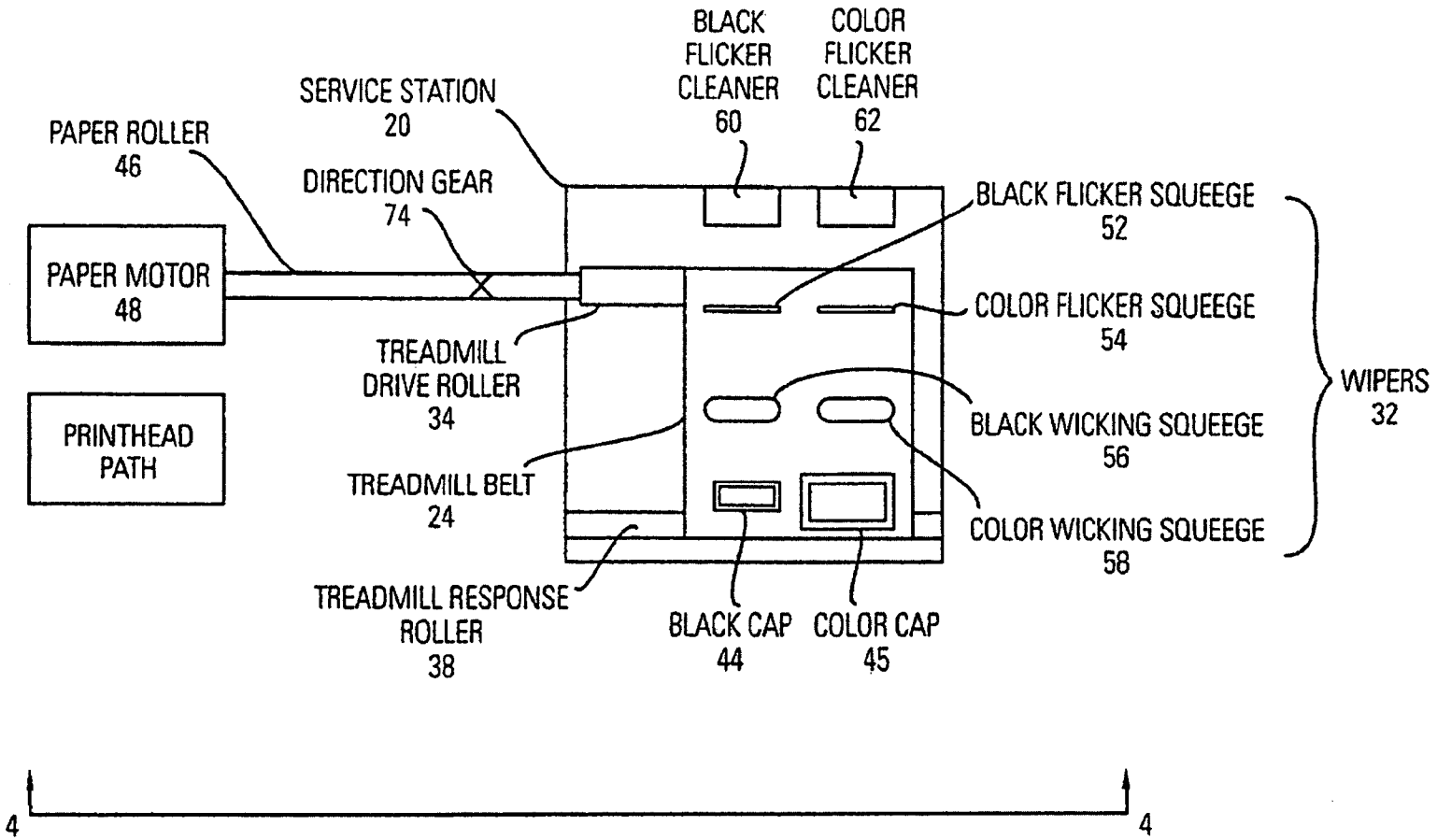
FIG. 3 illustrates a top view of a service station in accordance with one embodiment of the present invention.

FIG. 3 illustrates a top view of a service station 20 in accordance with one embodiment of the present invention. One primary function of the service station 20 is to move wipers with respect to the print head in order to maintain and clean the print head. In one embodiment, the wipers move across the pens in a direction that is parallel to the direction that the paper moves in order to preserve the ink supply.

Through the use of gears connected to the paper rollers, the wipers can be made to clean the pens at the same time that the paper is being advanced, using the same motor source.

The service station of the present invention also performs a capping function. This function requires moving the caps into place as the pens come to rest. The motion of the pens themselves could easily push a lever that pushes the caps into place. A spittoon collects the residual ink.

The service station 20 includes a conveyor belt 24 (also referred to herein as a treadmill belt) that has an outer surface 26 and an inner surface 28. At least one wiper 32 is positioned on the outer surface 26 of the conveyor belt 24. The function and operation of the different types of wipers 32 are described in greater detail hereinafter.

The service station 20 also includes a first roller 34, which can be a treadmill drive roller, and a second roller 38, which can be a treadmill response roller. The conveyor belt 24 is mounted on the first roller 34 and the second roller 38 in such a manner that the first roller 34 and the second roller 38 contact the inner surface 28 of the conveyor belt 24 for driving the belt 24.

The conveyor belt 24 can also include one or more pen caps, such as a first pen cap 44 for the black ink pen 64 (e.g., a black pen cap) and a second pen cap 45 for the color ink pen 65 (e.g., a color pen cap).

Figure 5:
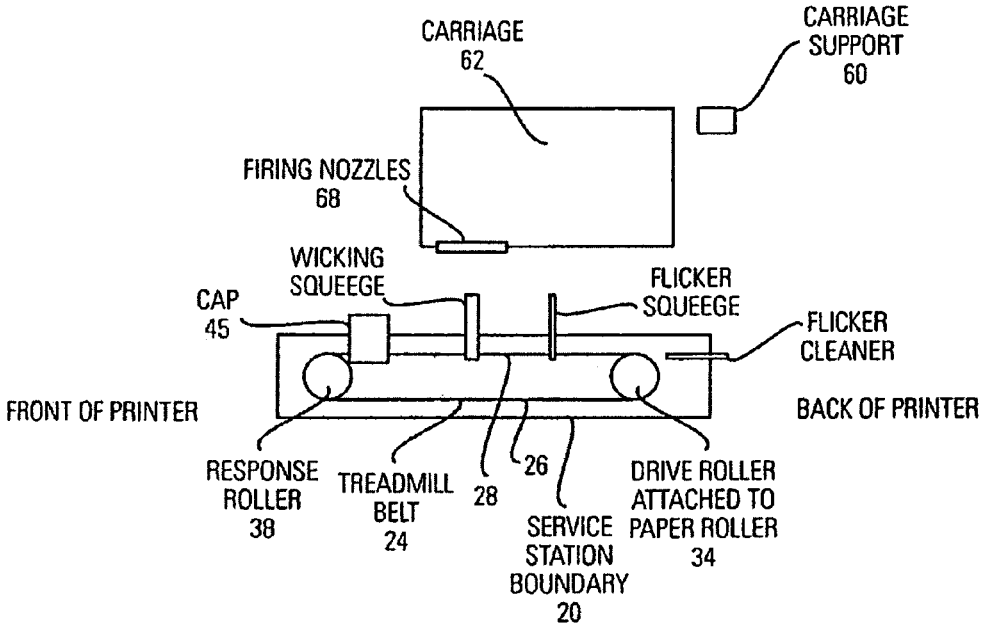
FIG. 5 illustrates a side view of a service station of FIG. 3, where the wiping elements are placed in a side-by-side configuration.

Preferably, the service station 20 includes a set of caps with one cap for each pen head. During the times when the printer is not in use, the pens are positioned over the service station 20, and the caps are moved by the service station 20 to cover the firing heads. The caps (e.g., caps 44 and 45) protect the ink in the orifices from drying out during periods of non-use. The treadmill belt 24 of the present invention provides the motion of the service station 20 with respect to the pens 64, 65 to enable capping and wiping functions. As shown in FIG. 5, there is no device positioned between the first roller 34 and second roller 38 that engages the inner surface 28 of the treadmill belt 24 so as to move the inner surface 28 and outer surface 26 toward a pen during a capping function.

A drive axle 46 is coupled to either the first roller 34 or the second roller 38. Preferably, the drive axle 46 is preferably a paper roller that extends from a paper motor 48.

The wipers 32 can include, for example, a black flicker squeegee 52, a color flicker squeegee 54, a black wicking squeegee 56, and a color wicking squeegee 58. In one embodiment, the wipers 32 can include short and stiff wipers. In another embodiment, the wipers 32 can include long and flexible wipers. Preferably, the wipers 32 are rubber squeegees that are manufactured from an ethylene, propylene diene modified co-polymer material.

The service station 20 of the present invention provides two pen wipe motions: 1) a wicking motion and 2) a flicker motion. The wiper blade 32 may have any topology ranging from short and stiff to long and flexible. To achieve a wicking motion, the wicking squeegee blade is slowly dragged across the pen head in order to pull some wet ink from each nozzle, thereby dissolving dried ink. To achieve a flicker motion, the flicker squeegee blade is rapidly drawn across the orifices to wipe excess ink from the pen. Because of these different types of motion, the service station 20 of the present invention preferably provides different speed controls for the treadmill belt 24.

The service station 20 includes flicker cleaners (e.g., a black flicker cleaner 60 and a color flicker cleaner 62) that are disposed on one wall of the station 20 for removing excess ink from the wipers 32 when the wipers 32 contact the cleaners 60,62. After performing a wipe, it is important to remove excess ink from the squeegees 32. The service station 20 of the present invention perform the ink removal by wiping the squeegees 32 across cleaners 60, 62, which may be a fixed plastic section extending from a wall of the service station sub-assembly 20. In one embodiment, after a pen wipe, the treadmill belt 24 is moved by rotating the rollers 34, 38, so that the squeegees 32 come into contact with the flicker cleaners 60, 62.

Figure 1:
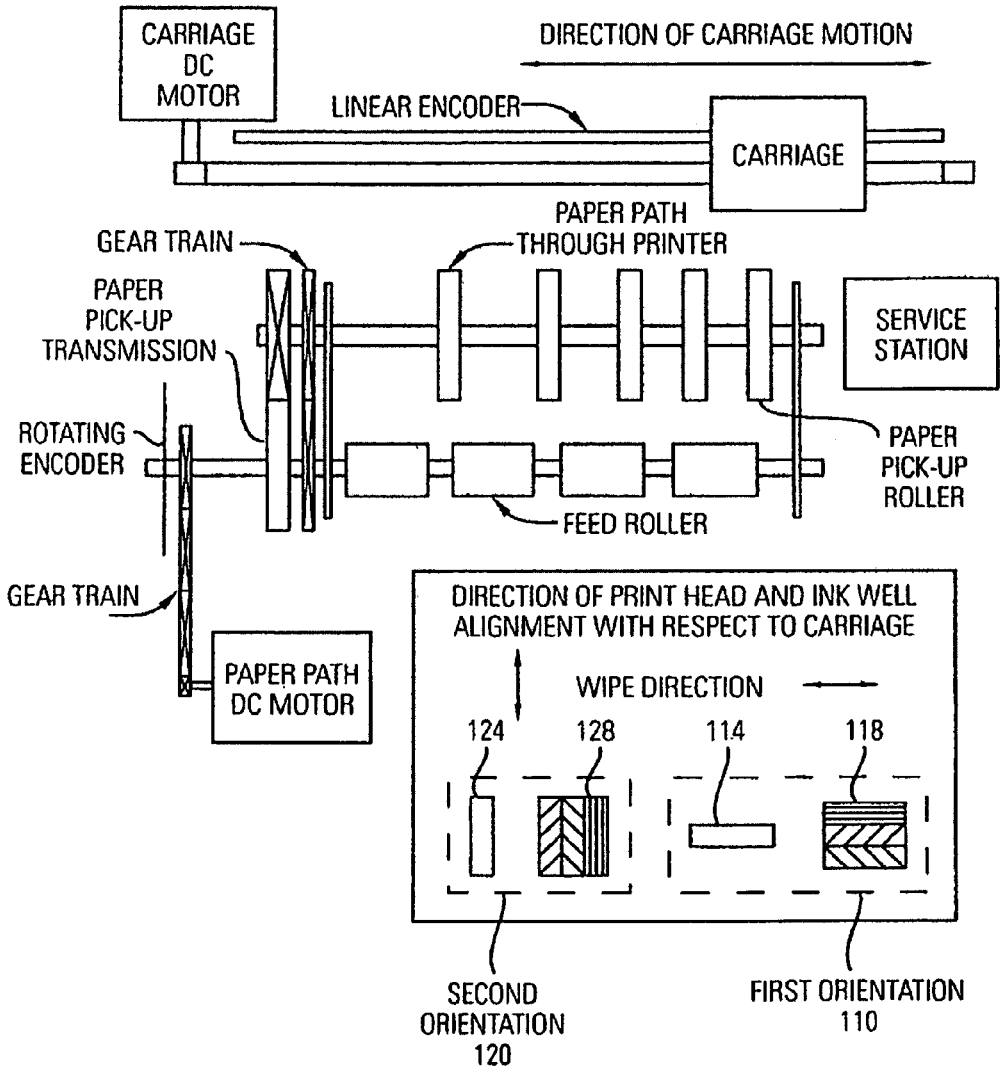
FIG. 1 (PRIOR ART)
FIG. 1 illustrates a first type of prior art multi-pass TIJ printer where the service station is stationary, and the carriage moves with respect to the stationary service station.
Figure 2:
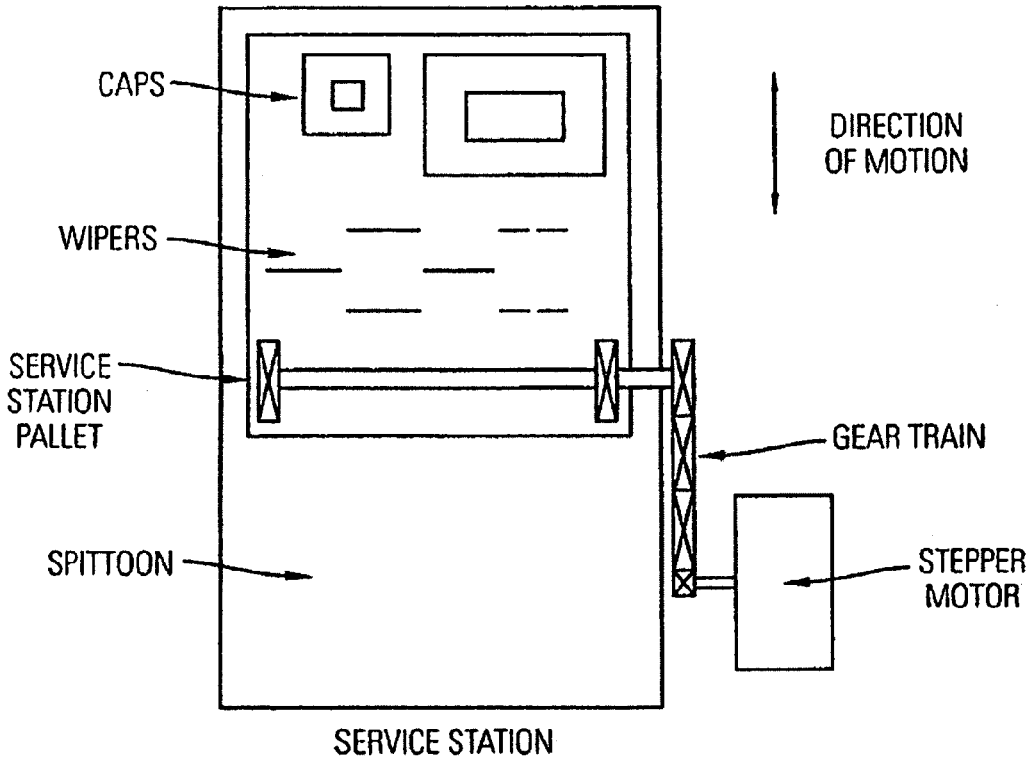
FIG. 2 (PRIOR ART)
FIG. 2 illustrates a second type of prior art single-pass TIJ printer where a dedicated motor controls the movement of the service station.
Figure 4:
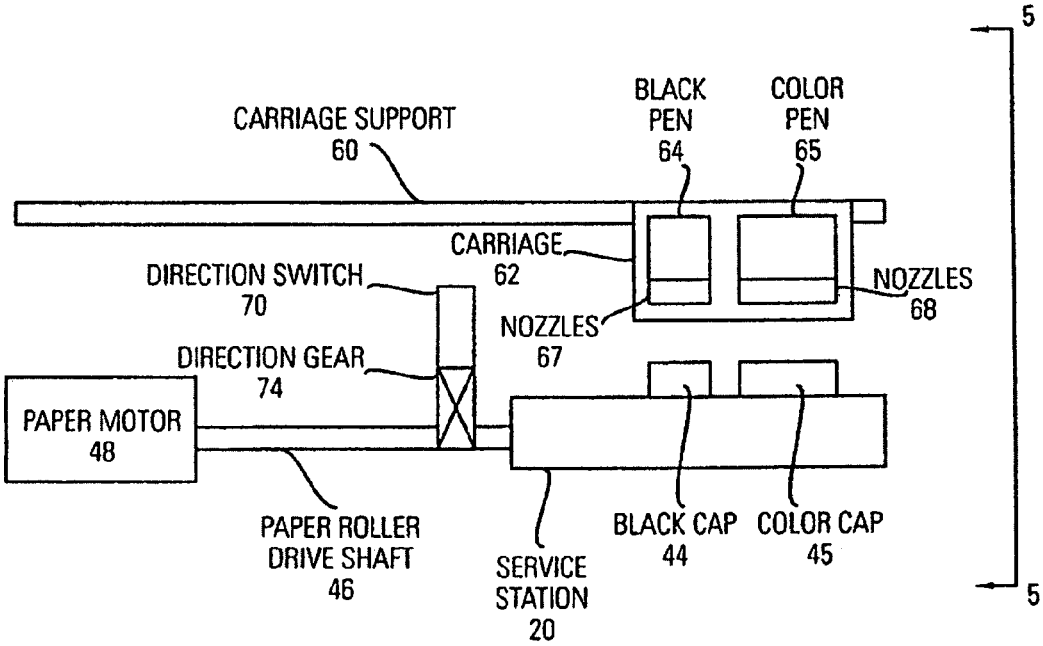
FIG. 4 illustrates a front view of the service station of FIG. 3.

FIG. 4 illustrates a front view of the service station 20 of FIG. 3. FIG. 5 illustrates a side view of a service station 20 of FIG. 3. In FIGS. 4 and 5, a carriage support 60 for supporting a carriage 62 can be seen. The carriage 62 is slidably mounted on the carriage support 60 for motion along a first direction 63 and can include a black pen 62 and a color pen 64. The black pen 62 has a plurality of firing nozzles 67 for depositing black ink. Similarly, the color pen 64 has a plurality of firing nozzles 68 for depositing different color inks (e.g., cyan color ink, magenta color ink, and yellow color ink). The firing nozzles are configured in the second orientation 120 as shown in FIG. 1.

As described previously, these pens 64, 65 may be capped with caps 44, 45, respectively when the carriage 62 is positioned in proximity to the caps 44, 45 of the service station 20.

A direction switch 70 and a direction gear 74 are provided to switch the direction of travel of the treadmill belt 24. The direction gear 74 translates the motion of the paper roller 46 into either a first direction or a second direction as set by the direction switch 70. The direction switch 70 has first position and a second position. When the direction switch 70 is in the first position, the direction gear 74 translates the motion of the paper roller 46 into the first direction. When the direction switch 70 is in the second position, the direction gear 74 translates the motion of the paper roller 46 into the second direction. In this manner, the direction of travel (e.g., forward or backward) of the treadmill belt 24 can be controlled.

The service station 20 of the present invention maintains the pens (e.g., pens 64 and 65) by performing the following steps. First, a rubber blade that is passed over the firing orifices, thereby cleaning them of excess ink. For example, the rubber blade (e.g., the flicker squeegees 52, 54 and wicking squeegees 56, 58) can periodically wipe the pens 64 and 65. When the pens are not being maintained, the service station sub-assembly 20 is placed on one side of the paper path. When the pens require maintenance (i.e., a wipe is needed), the pen carriage 62 moves the pens 64, 65 over the treadmill belt 24; the paper roller 46 turns, and the squeegees 32 are moved across the orifice plate. Mounting the treadmill belt 24 in this orientation provides the correct squeegee motion for pens that move perpendicular to the carriage axis.

Second, all the pens are periodically fired into a spittoon 400 as schematically shown in FIG. 5 (the representation of spittoon 400 in FIG. 5 is not to denote a particular structure or orientation of the spittoon). For example, this step can occur at intervals when the dot-count reaches a certain value. This dot-count indicates that a set of the orifices within a pen have been fired a certain number of times, while other orifices within the same pen have not. During this servicing step, the carriage is positioned over the spittoon, and all the orifices are fired. This step has the effect of ensuring the reservoirs maintain the appropriate level of pressure and fluidity, and ensuring that all the orifices do not clog or weep.

According to one embodiment, the treadmill belt 24 is made from a reinforced, ethylene, propylene diene modified (EPDM) co-polymer material. The EPDM material can be molded into continuous belt for providing the wipe function. The squeegee elements are preferably molded on the outer surface of the belt. This treadmill belt is mounted on two rollers that contact the surface of the belt. One roller is an idler, and the other roller is affixed to the drive roller.

In one embodiment, a transmission may be provided to engage the treadmill belt upon demand. For example, the pen carriage can trip the transmission when it is in position for a wipe. In this embodiment, the wipe cannot be performed while paper is loaded in the drive roller. For example, the pen wipe can be performed during the pen-cap and pen-uncap steps.

The axial motion of the carriage can be transformed into perpendicular-to-axial motion for the wipers through a number of mechanical means (e.g. levers, gears, springs, or a combination thereof). The carriage motion may be used to raise and lower the pen caps also through a series of levers, gears, springs, or a combination thereof.

It is noted that when more than one style of wiping element is needed for a certain application, the treadmill belt 24 can be widened to accommodate the different wiping elements. For example, the different wiping elements can be arranged in a side-by-side manner as shown in FIG. 3.

Figure 8:
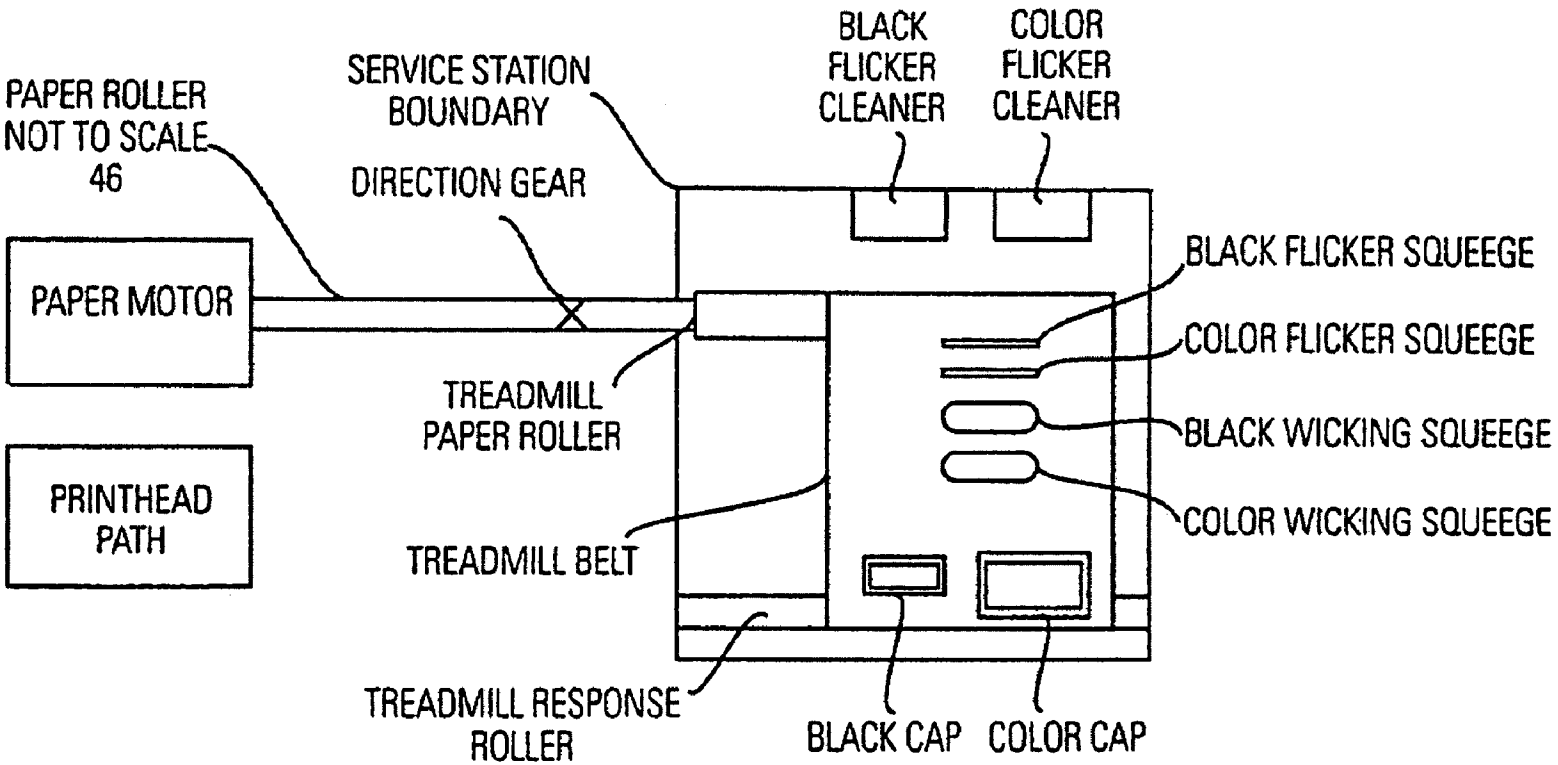
FIG. 8 illustrates a side view of a service station configured in accordance with another embodiment of the present invention, where the wiping elements are placed in a column configuration.

Alternatively, the different wiping elements can be arranged in a column configuration, but offset from each other, at different locations along the length of the belt as shown in FIG. 8. In this embodiment, the belt is wider, and the print heads on the carriage are placed over a different position on the belt. The wiping action is the same as described previously.

Processing Steps

Figure 6:
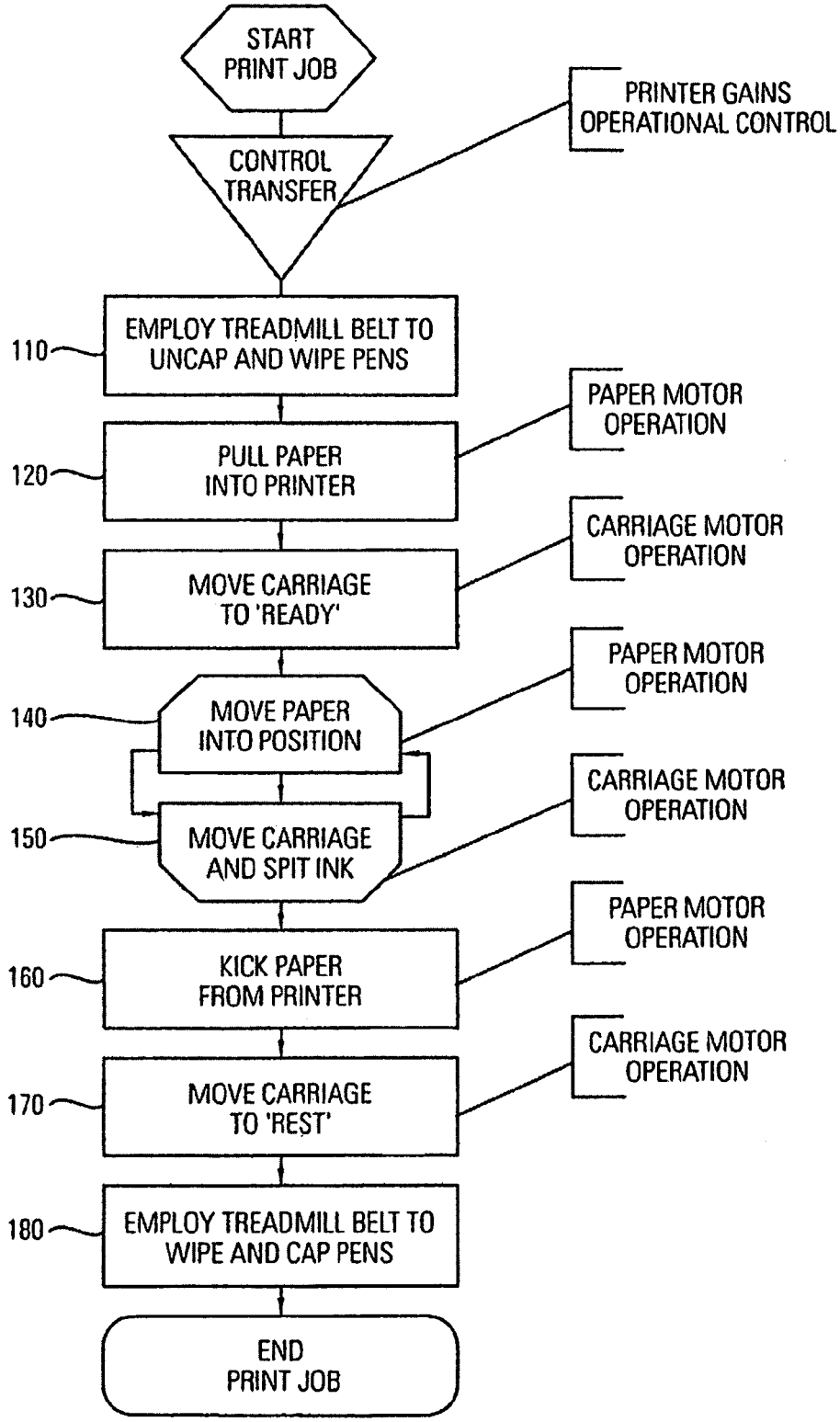
FIG. 6 is a flowchart illustrating the processing steps performed by a thermal inkjet printer having a service station that uses a treadmill belt.

FIG. 6 is a flowchart that describes the general steps performed by the service station of the present invention in accordance with one embodiment of the present invention. In step 100, the printer gains operational control of the job. In step 110, the pens are uncapped and wiped. In step 120, paper is pulled into the printer. In step 130, the carriage is initialized. In step 140, the paper is advanced. In step 150, the carriage is moved and ink is spit onto the paper. Steps 140 and 150 are repeated until the print job is complete. A new piece of paper is loaded without servicing the pens. The rest of the flow chart corresponds to when the last page is printed. In step 160, the paper is "kicked" from the printer, coming to rest in the out tray. In step 170, the carriage is moved to the "rest" position. In step 180, pens are wiped and capped. It is noted that the pen servicing can also occur periodically during a print job (e.g., when a predetermined number of drops of ink have been fired) without regard to state of paper load or the length of the job.

Processing Steps for Embodiment where Paper Motor Drives Treadmill Belt

Figure 7:
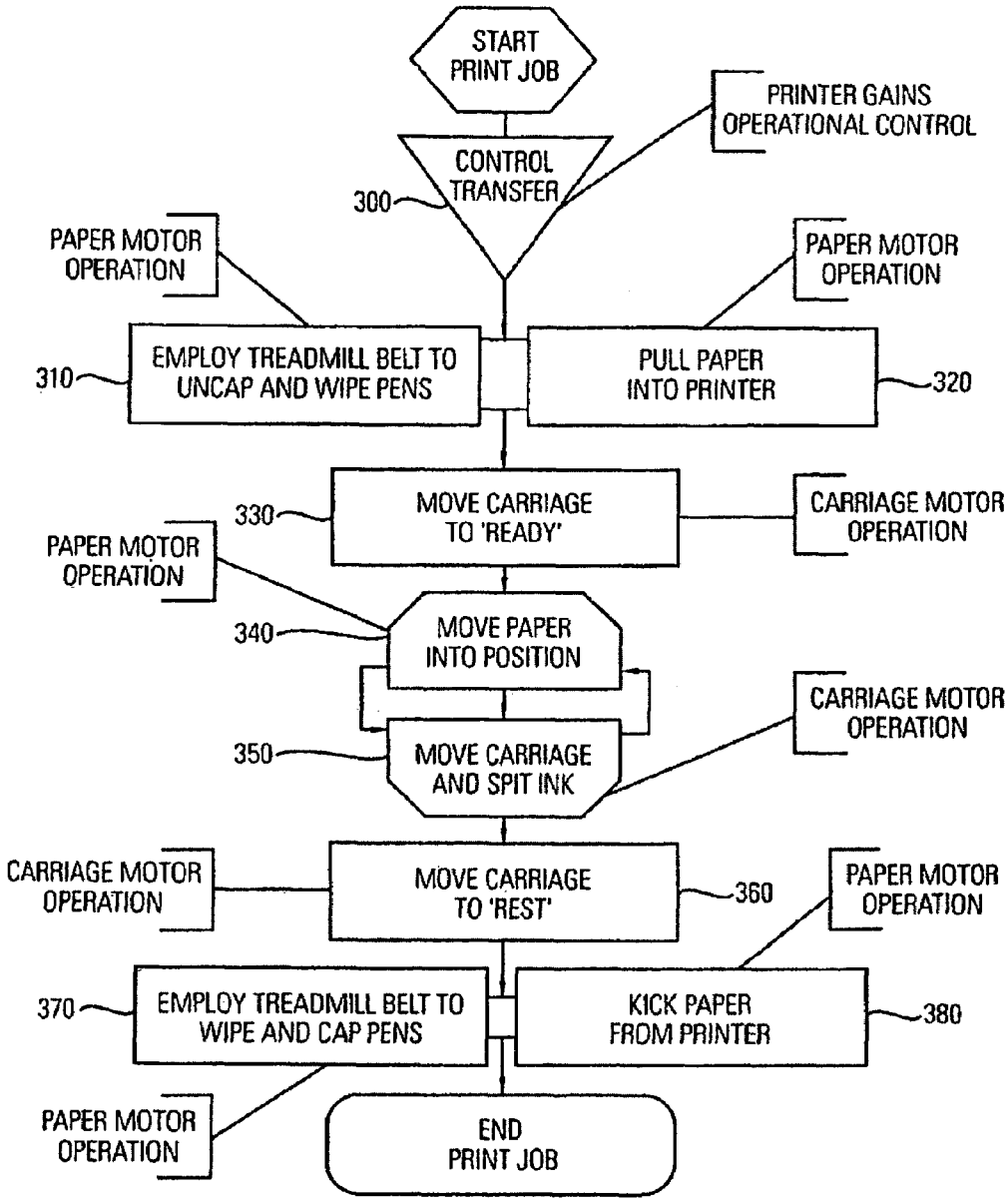
FIG. 7 is a flowchart illustrating the processing steps performed by a thermal inkjet printer having a service station with a service station that is powered by the paper motor.

FIG. 7 illustrates a process flowchart corresponding to a thermal inkjet printer having a paper motor coupled to the service station. In step 300, the printer gains operational control of the job. In step 310, the pens are uncapped and wiped. In step 320, paper is pulled into the printer. Steps 310 and 310 may occur simultaneously. In step 330, the carriage is initialized. In step 340, the paper is advance. In step 350, the carriage is moved and ink is spit onto the paper. Steps 340 and 350 are repeated until the job is printed. In step 360, the carriage is moved into the "rest" position. In step 370, the pens are wiped and capped. In step 380, the paper is "kicked" from the printer. Steps 370 and 380 may occur simultaneously.

FIG. 8 illustrates a side view of a service station configured in accordance with another embodiment of the present invention, where the wiping elements are placed in a line. In this embodiment, the wiping elements (e.g., the black flicker squeegee, the color flicker squeegee, the black wicking squeegee, and the color wicking squeegee) are positioned in a line format.

One benefit to placing the wipers along the length of the belt rather than across the width is that there is more available space on the length. For example, with four types of wipers required (i.e., two wipers per color), when the wipers are disposed or placed at different points along the length rather than at the same point in length but across the width, the service station assembly may be made smaller in size.

While in the preferred embodiment, the paper motor transfers power to the service station, it will be apparent to those with skill in the art that other motors (e.g., the carriage motor or a separate dedicated motor) may be used individually or in concert to transfer power to the service station.

As can be appreciated, the service station of the present invention for a single-pass TIJ printer has a simplified and more compact design than prior art solutions previously described. Moreover, the service station of the present invention has a simplified drive train that has fewer parts (e.g., gears), is lighter, and is easier to assemble than the service stations in prior art single-pass TIJ printers. By employing a treadmill belt for performing the pen servicing functions, the service station of the present invention reduces manufacturing costs and complexity.

In the foregoing specification, the invention has been described with reference to specific embodiments thereof. It will, however, be evident that various modifications and changes may be made thereto without departing from the broader scope of the invention. The specification and drawings are, accordingly, to be regarded in an illustrative rather than a restrictive sense.

What is claimed is:

1. A service station for a pen, comprising:

a treadmill belt that has an outer surface and an inner surface;

a pen cap positioned on the outer surface of the treadmill belt, wherein the pen cap is positioned between the treadmill belt and the pen when the pen cap is utilized to cap the pen;

a first roller;

a second roller;

wherein the treadmill belt is mounted on the first roller and the second roller; and wherein the first roller and the second roller contact the inner surface of the treadmill belt for driving the treadmill belt;

a drive axle coupled to one of the first roller or the second roller; and a mechanism for switching a direction of travel of the treadmill belt wherein the mechanism comprises:

a direction switch for selecting a first direction or a second direction of travel, wherein the direction switch includes a first position and a second position; and a direction gear coupled to the direction switch for switching the direction of travel of the treadmill belt;

wherein the direction gear translates the motion of a paper roller into either a first direction or a second direction of motion; and wherein when the direction switch is in the first position, the direction gear translates the motion of the paper roller into the first direction of motion, and when the direction switch is in the second position, the direction gear translates the motion of the paper roller into the second direction of motion.

2. The service station of claim 1, comprising:

a wiper positioned on the outer surface of the treadmill belt.

3. The service station of claim 1, wherein the wiper can be one of a wicking squeegee or a flicking squeegee.

4. The service station of claim 1, wherein the wiper includes a short and stiff wiper.

5. The service station of claim 1, wherein the wiper includes a long and flexible wiper.

6. The service station of claim 1, further comprising:

a flicker cleaner for use by the wiper to remove excess ink therefrom.

7. The service station of claim 1, wherein the wiper is a rubber squeegee that is manufactured from an ethylene, propylene diene modified co-polymer material.

8. The service station of claim 1, further comprising: an additional wiper; wherein the wiper and the additional wiper are disposed in a side-by-side arrangement.

9. The service station of claim 1, further comprising: an additional wiper; wherein the wiper and the additional wiper are disposed in a line arrangement.

10. The service station of claim 1, wherein the wiper extends lengthwise along a line.

11. The service station of claim 10, wherein the line is perpendicular to the direction of travel of the treadmill belt.

12. The service station of claim 1, wherein the wiper is linear in shape.

13. The service station of claim 1, wherein the wiper is oriented parallel to a front edge of firing heads of the pen.

14. The service station of claim 1, wherein the pen is a black ink pen and the service station further comprises a second pen cap on the treadmill belt that is for a color ink pen.

15. The service station of claim 1, wherein a paper motor drives the drive axle.

16. The service station of claim 1, wherein the service station is implemented in a single-pass thermal inkjet printer.

17. The service station of claim 1, further comprising a spittoon, wherein the spittoon receives ink directly from the pen.

18. A method for servicing a pen in a printer, the method comprising:

providing a treadmill belt in a service station that includes a cap positioned on the treadmill belt, wherein the treadmill belt can be driven in two directions;

driving the treadmill belt in at least one direction to service the pen;

driving the treadmill belt for applying the cap to the pen and removing the cap from the pen, wherein the cap is positioned between the treadmill belt and the pen when the cap is utilized to cap the pen; and using a direction gear to simultaneously switch a direction of travel of the treadmill belt and translate a motion of a paper roller into either a first direction or a second direction of motion so as to move a piece of paper via the paper roller.

19. The method of claim 16, further comprising using a paper motor to drive the treadmill belt in the two directions; and driving the treadmill belt for engaging the wiper with a flicker cleaner to wipe excess ink off the wiper.

20. The method of claim 18, wherein the method is applied to a single-pass thermal inkjet printer.

21. The method of claim 17, wherein the method is applied to a single-pass thermal inkjet printer.

22. The method of claim 19 wherein the wiper extends lengthwise along a line. directing ink from the pen directly into a spittoon.

23. The method of claim 22, wherein the line is perpendicular to the direction of travel of the treadmill belt.

24. The method of claim 19, wherein the wiper is linear in shape.

25. The method of claim 19, wherein the wiper is oriented parallel to a front edge of firing heads of the pen during movement of the wiper relative to the firing heads of the pen.

26. The printer of claim 22, further comprising additional means for wiping a pen; wherein the means for wiping a pen and the additional means for wiping a pen are disposed in a line arrangement.

27. The method of claim 18, further comprising directing ink from the pen directly into a spittoon.

28. A printer comprising:

means for capping a pen;

a treadmill belt that has an outer surface and an inner surface, wherein the means for capping is positioned on the outer surface of the treadmill belt, wherein the means for capping is positioned between the treadmill belt and the pen when the means for capping is moved to a position so as to engage the pen;

a paper roller that moves a piece of paper;

means for driving the treadmill belt; and means for switching a direction of travel of the treadmill belt by translating a motion of the paper roller into a forward direction or a backward direction of travel of the treadmill belt.

29. The printer of claim 28, further comprising a means for wiping a pen.

30. The printer of claim 29, further comprising means for removing excess ink from the means for wiping a pen.

31. The printer of claim 29, further comprising additional means for wiping a pen; wherein the means for wiping a pen and the additional means for wiping a pen are disposed in a side-by-side arrangement.

32. The printer of claim 29, further comprising additional means for wiping a pen; wherein the means for wiping a pen and the additional means for wiping a pen are disposed in a line arrangement.

33. The printer of claim 29, wherein the means for wiping a pen extends lengthwise along a line.

34. The service station of claim 33, wherein the line is perpendicular to the direction of travel of the treadmill belt.

35. The printer of claim 29, wherein the means for wiping a pen is linear in shape.

36. The printer of claim 29, wherein the means for wiping a pen is oriented parallel to a front edge of firing heads of the pen.

37. The printer of claim 28, further comprising a spittoon, wherein the spittoon receives ink directly from the pen.

38. A printer comprising:

a pen that moves translationally;

a service station for the pen, the service station comprising:

a treadmill belt that has an outer surface and an inner surface;

a pen cap positioned on the outer surface of the treadmill belt, wherein the pen cap is positioned between the treadmill belt and the pen when the pen cap is moved to a position so as to engage the pen;

a first roller;

a second roller;

wherein the treadmill belt is mounted on the first roller and the second roller; and wherein the first roller and the second roller contact the inner surface of the treadmill belt for driving the treadmill belt, wherein the treadmill belt moves the pen cap to the position so as to engage the pen;

a drive axle coupled to one of the first roller or the second roller; and a mechanism for switching a direction of travel of the treadmill belt, wherein the mechanism comprises:

a direction switch for selecting a first direction or a second direction of travel; and a direction gear coupled to the direction switch for switching the direction of travel of the treadmill belt by translating a motion of a paper roller into either a first direction or a second direction of motion.

39. The printer of claim 38, further comprising a spittoon, wherein the spittoon receives ink directly from the pen.

40. A method of printing paper by a printer, the method comprising:

providing a pen that is uncapped;

positioning paper relative to the pen;

transferring ink from the pen to the paper;

providing a treadmill belt that has an outer surface upon which a pen cap is supported, wherein the treadmill belt can be driven in two directions; and driving the treadmill belt in at least one direction so that the pen cap is moved to a position so as to cap the pen, wherein during the driving the pen cap is positioned between the treadmill belt and the pen, wherein a direction gear switches a direction of travel of the treadmill belt by translating a motion of a paper roller into either a first direction or a second direction of motion.

41. The method of claim 40, further comprising driving the treadmill belt in at least one direction to service the pen by wiping the pen via a wiper supported on the outer surface of the treadmill belt.

42. The method of claim 41, further comprising wiping excess ink off the wiper.

43. The method of claim 41, wherein the wiper extends lengthwise along a line.

44. The method of claim 43, wherein the line is perpendicular to a direction of travel of the treadmill belt.

45. The method of claim 41, wherein the wiper is linear in shape.

46. The method of claim 33, wherein the wiper is oriented parallel to a front edge of firing heads of the pen during movement of the wiper relative to the firing heads of the pen.

47. The method of claim 40, wherein the method is applied to a single-pass thermal inkjet printer.

48. The method of claim 40, further comprising directing ink from the pen directly into a spittoon.

* * * * *